US007060163B2

(12) United States Patent
Haider et al.

(10) Patent No.: US 7,060,163 B2
(45) Date of Patent: Jun. 13, 2006

(54) DEVICE FOR CONTINUOUS DRYING OF A PULP SHEET

(75) Inventors: Franz Haider, Graz (AT); Gerald Schadler, Vasoldsberg (AT); Wilhelm Mausser, Graz (AT)

(73) Assignee: Andritz AG, Graz (AT)

( * ) Notice: Subject to any disclaimer, the term of this patent is extended or adjusted under 35 U.S.C. 154(b) by 124 days.

(21) Appl. No.: 10/684,755

(22) Filed: Oct. 14, 2003

(65) Prior Publication Data

US 2004/0128855 A1 Jul. 8, 2004

(30) Foreign Application Priority Data

Oct. 14, 2002 (AT) ..... A 1552/2002

(51) Int. Cl.
*D21F 5/00* (2006.01)

(52) U.S. Cl. ..... 162/375; 34/114; 34/115; 34/116; 34/122; 34/273; 34/269

(58) Field of Classification Search ..... 162/375; 34/114, 122–124, 110, 273, 269, 115, 119
See application file for complete search history.

(56) References Cited

U.S. PATENT DOCUMENTS 3,781,957 A * 1/1974 Luthi ..... 492/32
4,184,268 A * 1/1980 Christin et al. ..... 34/124
4,781,795 A * 11/1988 Miller ..... 162/358.5
4,990,751 A * 2/1991 Nous ..... 219/469
5,575,080 A * 11/1996 Fleissner ..... 34/122

* cited by examiner

*Primary Examiner*—Mark Halpern
(74) *Attorney, Agent, or Firm*—Alix, Yale & Ristas, LLP

(57) ABSTRACT

The invention relates to a device for continuous drying of a pulp sheet 10, particularly a tissue web, with a drying drum 1 and an air circulating system. It is mainly characterised by the drying drum 1 having a shell 12 with a perforated cylinder 20 that is externally supported by radial bearing rings 21.

17 Claims, 6 Drawing Sheets

Fig.5a
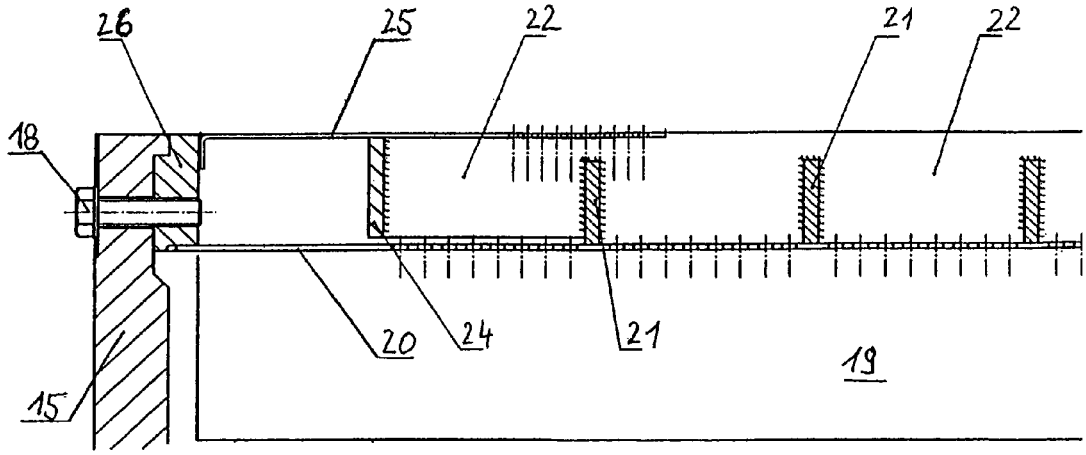
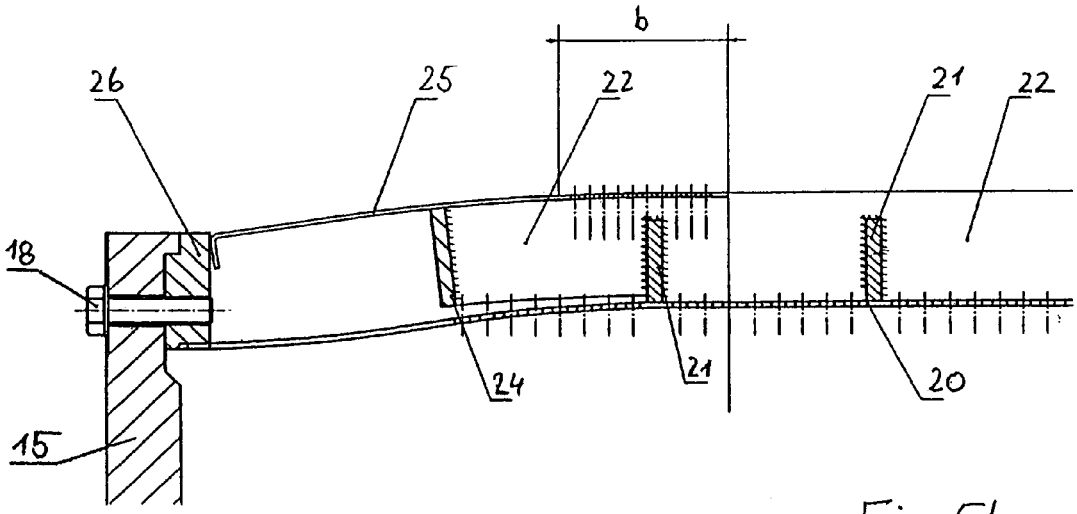
Fig.5b

DEVICE FOR CONTINUOUS DRYING OF A PULP SHEET

RELATED APPLICATION

This application claims priority under 35 U.S.C § 119, from Austrian Patent Application No. A1552/2002 filed Oct. 14, 2002.

BACKGROUND OF THE INVENTION

The invention relates to a device for continuous drying of a pulp sheet, particularly a tissue web, with a drying drum and an air circulating system.

In conventional tissue plants, the drying process begins at an inlet dryness of some 40 to 45% in the tissue web. In order to achieve higher paper volume, mechanical pre-dewatering on presses is omitted and the inlet dryness to this equipment nowadays is approximately 20 to 25%. These plants operate with through drying. If there is no paper in the plant, e.g. if there is a sheet break, there is a problem because the drying drum is exposed to high temperatures in the vicinity of the paper web for short periods and the difference in temperature between drum and end cover can cause increased stress and thus, damage to the drum. The aim of the invention is to eliminate this disadvantage.

SUMMARY OF THE INVENTION

The invention is characterised by the drying drum having a perforated cylinder that is supported by external radial bearing rings. With this design the drum shell is centered, thus guaranteeing exact roundness at all times.

A favorable configuration of the invention is characterised by the perforations in the cylinder being in the form of holes.

In one aspect the invention is directed to the combination of a drum, axle means along the drum centerline for supporting the weight of the drum, journal means associated with the drum and the axle, a motor for imparting a rotational torque to the drum, and a hot air supply for delivering a flow of hot air to the drum for drying a paper pulp sheet or web carried on a circumferential portion of the drum as the drum rotates, wherein the improvement comprises that the drum has means for rigidly supporting a perforated drum cylinder relative to the journal means, and an outer shell including the perforated cylinder and a plurality of circumferential bearing rings fixed to the exterior of the cylinder. Preferably, at least three radial bearing rings are welded to the cylinder.

The radial bearing rings in essence provide a series of belts around the cylinder that tightly (via welding) support the cylinder wall at the outside as the cylinder tries to expand non-uniformly during transient conditions.

An advantageous further development of the invention is characterised by longitudinal ribs being provided in the axial direction, where the longitudinal ribs can be arranged at a distance of 40 to 80 mm from one another. The longitudinal ribs provide stability for the drying shell. If the longitudinal ribs are welded to the radial bearing rings as well as to the perforated cylinder, this results in a complete, load-bearing unit.

A particularly favorable further development of the invention is characterised by the longitudinal ribs at the edges of the cylinder being welded to the outermost radial bearing ring only, where the outermost radial bearing ring is not connected to the cylinder. As a result, the drum can adjust to the various temperatures between the hot blow-air applied over the working width and the lower temperatures at the peripheral areas in such a way that there is no increased thermal stress in the shell and thus, the risk of cracks is virtually eliminated.

An advantageous configuration of the invention is characterised by a circumferential ring being secured to each of the outermost radial bearing rings, which extends from the end cover internal flanges to the edge of the paper web, where the circumferential ring can have a pattern of perforations. As a result, a certain amount of cooling air, which is blown out of the high-efficiency hood onto the edge of the drum, can be discharged.

A favorable further development of the invention is characterised by end covers screwed to the drum shell, being provided on the end faces of the cylinder in order to stabilize the drum shell. This design guarantees improved stability of the drum shell and, in particular, prevents any sliding movement between end cover and drum shell in the event of radial expansion due to the temperature.

An advantageous configuration of the invention is characterised by the drying drum having a drum body that is welded only. This design virtually eliminates the risk of areas in which cracks could occur.

BRIEF DESCRIPTION OF THE DRAWINGS

The invention will now be described using the examples in the drawings, wherein:

FIG. 5*a* is an extract from FIG. 3 according to the circle marked V, and FIG. 5*b* shows the same section when higher temperatures are applied.

DESCRIPTION OF THE PREFERRED EMBODIMENT

Figure 1:
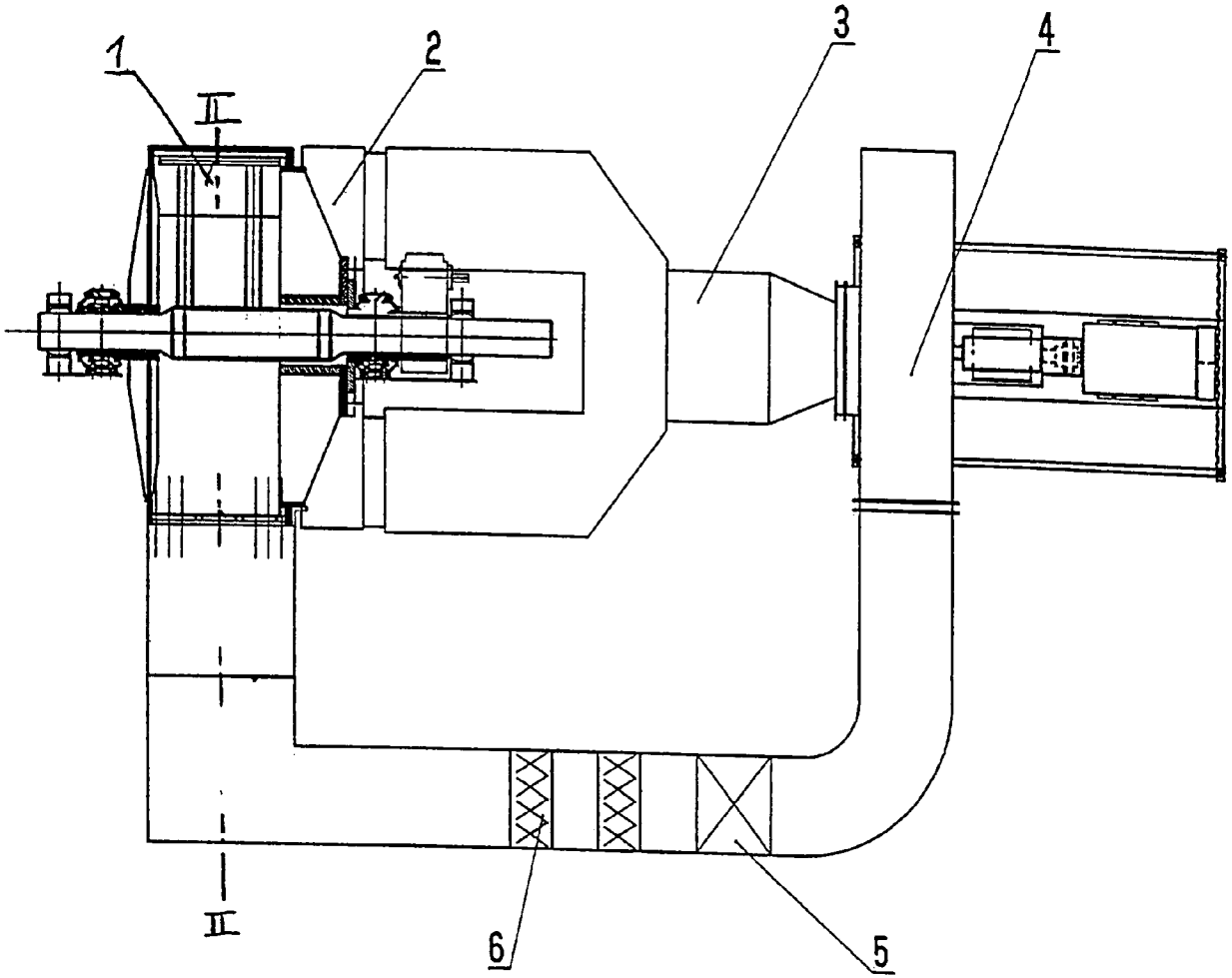
FIG. 1 shows a general view of a drying plant according to the invention.

FIG. 1 shows a sectional view through a drying drum 1, which is fitted with an annular channel 2 on the drive side in order to extract the exhaust air. The exhaust air is brought through a return duct 3 to a fan 4, which sends it back to the drying drum 1 via an air heating device 5, which can be designed as a burner or heat exchanger, and an integrated air mixing device 6. The temperature of the exhaust air is normally some 120° C., while the supply air to the drying drum has a temperature of approximately 260 to 300° C.

Figure 2:
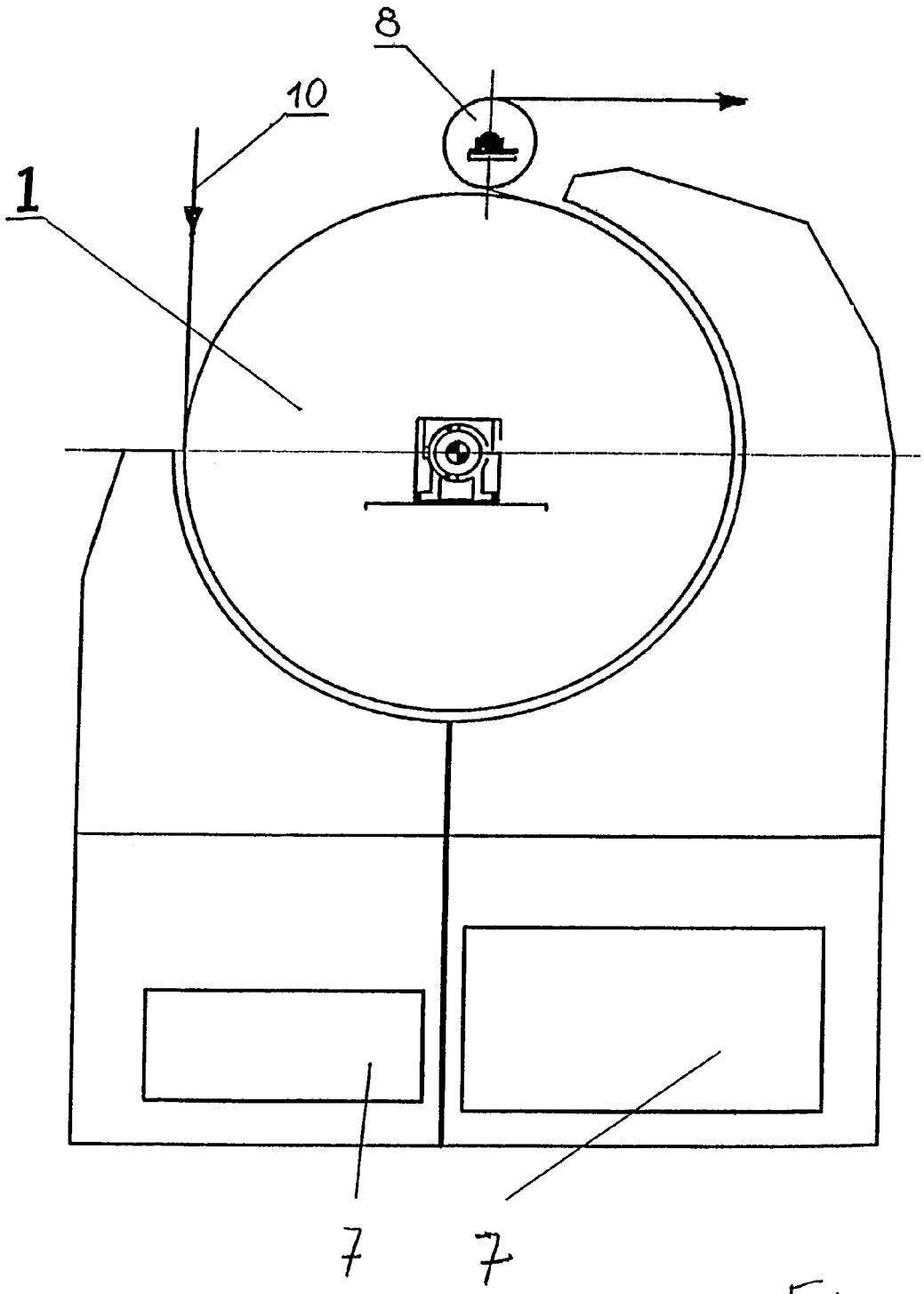
FIG. 2 contains a sectional view along the line marked II—II in FIG. 1.

FIG. 2 shows a section through the drying drum 1 according to the line marked II—II in FIG. 1. The paper web 10, particularly a tissue web, arrives at the drying drum 1 with approximately 20 to 25% dryness, supported on an endless wire. The hot air, with a temperature of approximately 260 to 300° C., preferably around 280° C., is blown onto the paper web 10 through a hood 7, which can consist of two parts as shown. The hood 7 largely surrounds the drying drum 1. After the drying process, the paper web, supported on an endless wire and with some 85% dryness, is guided round a deflection roll 8 and fed from there to a further drying process on a Yankee dryer (not shown).

Figure 3:
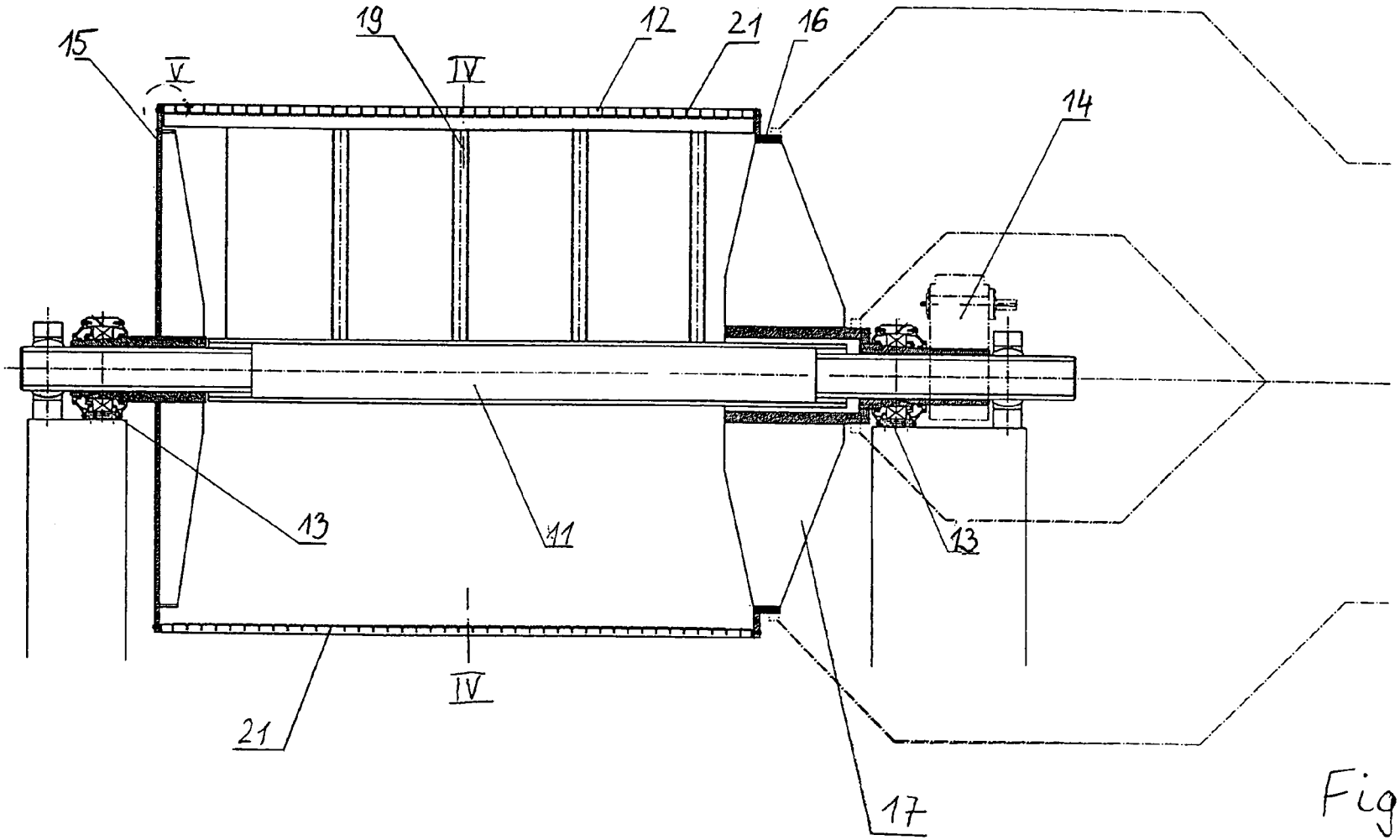
FIG. 3 shows a configuration of a drying drum according to the invention.

FIG. 3 is a sectional view through a possible variant of a drying drum 1 according to the invention. This illustration shows the axle 11 with the appropriate journal bearings 13 or the like for rotatably supporting the weight of the drum, the drive 14 for rotating the drum, and the drum shell 12, which is welded only. End covers 15, 16 are connected to the journal means 13 and attached to the end faces of the shell, with an annular suction channel 17 being flanged onto the latter of the two end covers. Furthermore, the illustration shows a covering device 19, mounted on the stationary axle 11, for that part c of the drum 1 (See FIG. 2) that is not wrapped in the tissue web 10.

Figure 4:
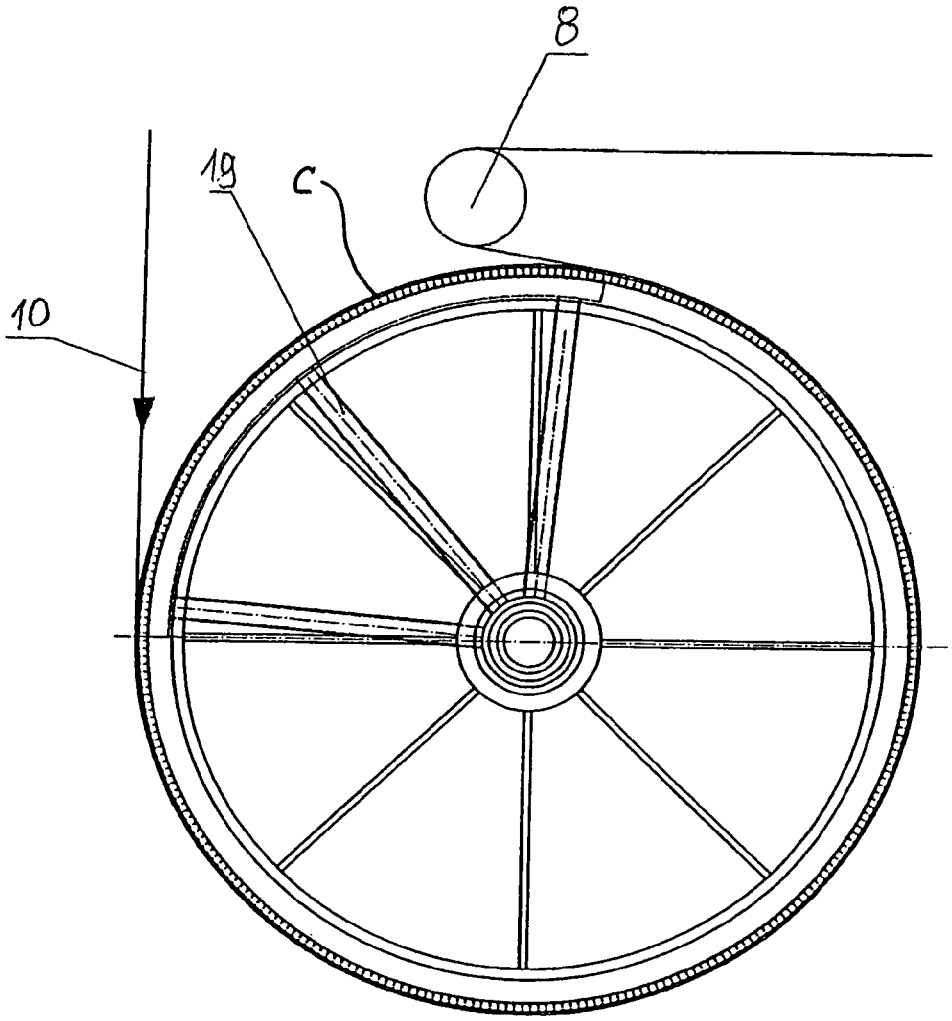
FIG. 4 contains a sectional view along the line marked IV—IV in FIG. 3.

FIG. 4 provides a sectional view along the line marked IV—IV in FIG. 3. This figure shows the drying drum 1 around which the tissue web 10 is guided. When it leaves the drying drum, the web 10 is fed round a deflection roll 8. Here, the covering device 19 is clearly discernible, covering the inside area c of the drum 1 in the section that does not come into contact with the tissue web 10 and also is not enclosed by the hood 7. This arrangement thus prevents infiltrated air from being sucked into the drum, which would seriously diminish the suction effect through the paper web 10.

FIG. 5*a* illustrates the structure of the drum shell 12 in an extract according to the circle marked V in FIG. 3. In addition to the covering device 19, the radially extending bearing rings 21, 24 are also clearly discernible here. This figure also shows the axially extending, longitudinal ribs 22 attached by welds where the ribs transversely intersect slots in the radial bearing rings 21 to form a substantially rectilinear grid (as viewed from above) defining a multiplicity of pockets. The radial rings 21 and the longitudinal ribs 22 are also welded to the hollow, perforated cylinder 20, which preferably has round holes. The perforated cylinder 20 with attached grid thereby defines the drum shell 12. The shell 12 is closed off at the cylinder ends with annular flanges 26. The cylinder 20 is welded to the flanges or end pieces 26 and the flange 26 can be considered part of the shell. In addition, the fastening screws 18 for attaching the flanges to the end covers 15, 16 are shown. This gives additional space for thermal expansion and helps avoid cracks in welds. Furthermore, this Figure shows the circumferential cooling ring 25 attached to the outermost bearing ring 24.

The same extract is shown in FIG. 5*b*, however this figure illustrates the condition when hot air at an approximate temperature of 260 to 300° C. is blown on without a paper web being present in between, i.e. the status at start-up or web break. The figure clearly shows that the outermost bearing ring 24 (i.e., closest to but spaced from covers 15, 16) is not welded to the cylinder 20, and the outer portion of the longitudinal ribs 22 between the outermost radial ring 24 and the adjacent radial ring 21 is likewise not welded to the cylinder. The axial ribs do not extend beyond the outermost bearing ring 24 so that the end regions outside of the web coverage on the shell have no axial ribs. Thus there is no longitudinal connection in the form of ribs at the ends of the drum, and during start-up and web break the axial ribs are only slightly deflected at the ends. As a result of the different temperatures between the middle region of the cylinder at approximately 260 to 300° C. and the outer edge with end covers 15, 16 at approximately 120° C., deformation occurs, where the configuration according to the invention can substantially reduce the stresses in the connecting welds compared with those occurring in other known designs.

The circumferential ring 25 attached to the outermost bearing ring 24 covers the end region of the drying drum 1 that has no contact with the paper web and has perforations, preferably with round holes, in an area b acting as an edge cooling zone, in order to discharge a certain amount of cooling air that is blown out of the high-efficiency hood onto the edge of the drum. Rings 25 prevents hot gases from exiting the shell at the ends. The hood has separate areas at the end side to blow cool air, i.e., cooler than the drying air, with temperatures up to 100° C. to the (end) rings 25 so that also here the terminal stresses to the end covers will be reduced.

In addition, this Figure shows where the face end covers 15, 16 are secured to the drum shell 12 (flange 26) by screws 18. This ensures that there is no sliding movement between the end covers 15, 16 and the drum shell 12 if there is radial expansion due to the effect of heat, and that a firm connection is always guaranteed.

Figure 6:
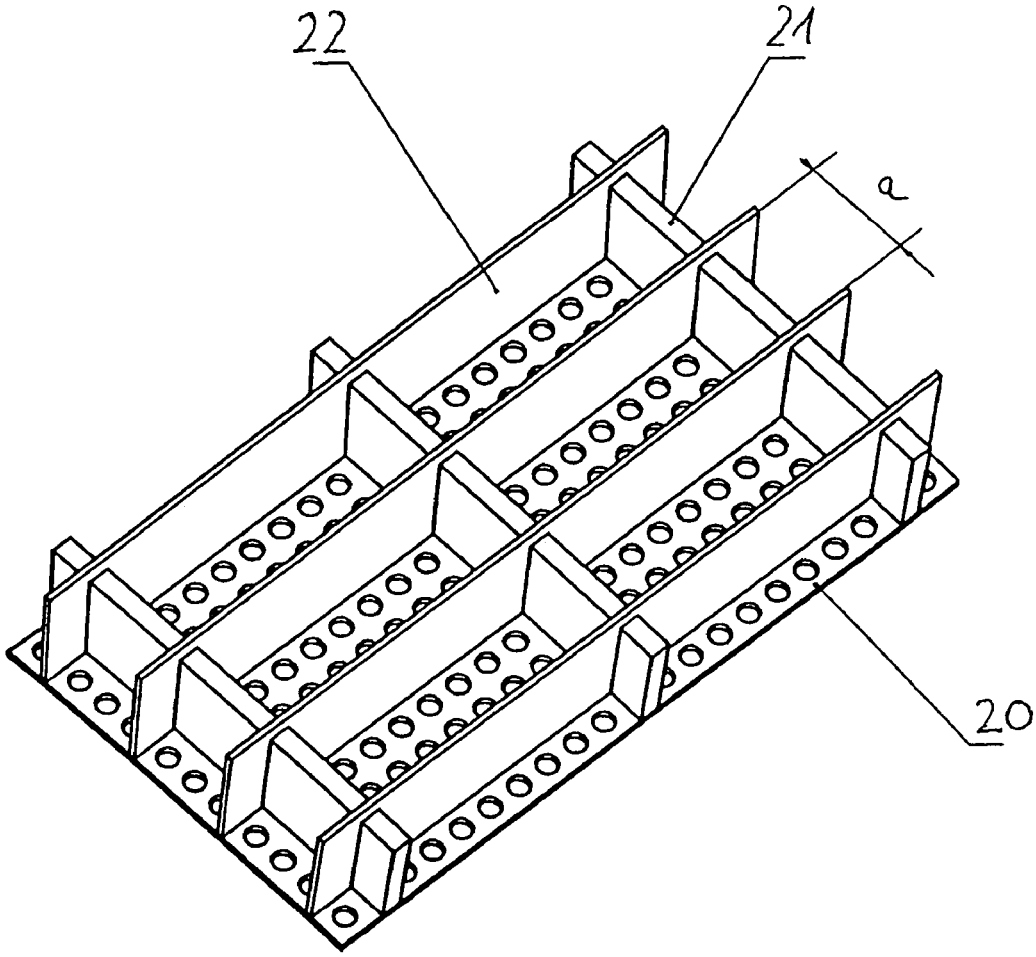
FIG. 6 shows a 3D illustration of a section of the cylinder shell according to the invention.

FIG. 6 contains a 3D illustration of a section through the shell according to the invention. This Figure shows the bearing rings 21 secured to the cylinder 20, which is perforated here, and the longitudinal ribs 22 mounted at right angles thereto at a distance a from one another, where this distance should preferably be 40 to 80 mm. Because of the pockets formed by this narrow spacing to each other, cross-flows of air across the width of the paper web are largely prevented, thus also preventing an irregular drying profile. The perforated cylinder 20 acts as a choke and prevents different amounts of through-flow air over the web width, regardless of the basis weight and dryness of the paper web to be dried.

The invention claimed is:

1. Device for continuous drying of a paper pulp web, with a drying drum and an air circulating system, wherein the improvement comprises that the drying drum has a shell including a perforated cylinder, a plurality of longitudinal ribs connected to the cylinder and extending between axially spaced ends of the cylinder, and a plurality of axially spaced apart radial bearing rings connected to the cylinder and to the longitudinal ribs, and that adjacent each of said ends of the cylinder the longitudinal ribs are welded to an axially outermost radial bearing ring without connection to the cylinder, and without connection of the outermost radial bearing ring to the cylinder.

2. Device according to claim 1, wherein the perforations are in the form of holes.

3. Device according to claim 1, wherein the plurality of radial bearing rings includes at least three rings welded to the cylinder.

4. Device according to claim 1, wherein the longitudinal ribs are arranged at a distance of 40 to 80 mm from one another.

5. Device according to claim 3, wherein the longitudinal ribs are welded to the at least three radial bearing rings, as well as to the perforated cylinder.

6. Device according to claim 1, wherein the drum has axial end covers and an annular flange inside each cover, and wherein a circumferential ring is secured to each of the outermost radial bearing rings and extends from the flange inwardly to the edge of the paper web when drying on the drum.

7. Device according to claim 6, wherein the circumferential ring has a pattern of perforations.

8. Device according to claim 1, comprising end covers screwed to the shell, at each axial end of the cylinder.

9. Device according to claim 1, wherein all the fixed connections in the shell, are welded only.

10. Apparatus having a drum, axle means along the drum centerline for supporting the weight of the drum, journal means associated with the drum and the axle, a motor for imparting a rotational torque to the drum, and a hot air supply for delivering a flow of hot air to the drum for drying a paper pulp sheet or web carried on a circumferential portion of the drum as the drum rotates, wherein the improvement comprises that the drum has means for rigidly supporting a perforated cylinder relative to the journal means, and an outer shell including the perforated cylinder and a plurality of axially spaced apart bearing rings fixed to the exterior of the cylinder, the outer shell including a plurality of axially extending longitudinal ribs that are rigidly connected to the radial bearing rings, thereby forming a multiplicity of pockets around the perforated cylinder, and the bearing rings closest to the axial ends of the cylinder are rigidly connected to the longitudinal ribs but not rigidly connected to the cylinder.

11. Apparatus according to claim 10, wherein the drum includes axially spaced apart end covers that are rigidly connected to the journal means, and said means for rigidly supporting the cylinder relative to the journal means includes said end covers.

12. Apparatus according to claim 11, wherein said means for rigidly supporting the cylinder relative to the journal means includes an annular flange bolted on each of said covers, said flanges facing each other and respectively rigidly supporting said cylinder.

13. Apparatus according to claim 12, wherein the drum includes spaced apart, perforated circumferential rings respectively extending axially from the flanges to at least said bearing rings closest to the covers.

14. Apparatus according to claim 13, wherein the cylinder is perforated uniformly along a central axial region and is not perforated at axial end regions, and wherein at least some perforations on the circumferential rings radially overlap some of the perforations in the central axial region.

15. Apparatus according to claim 12, wherein the axial ends of said shell are closed off by the annular flanges.

16. Apparatus according to claim 10, wherein the shell includes at least three bearing rings welded to the cylinder and an annular flange welded to each axial end of the cylinder, said flange being included in said means for rigidly supporting the perforated cylinder.

17. Apparatus according to claim 16, wherein the outer shell includes a plurality of axially extending ribs that are rigidly connected to the radial bearing rings, thereby forming a multiplicity of pockets around the perforated cylinder.

* * * * *